US008152935B2

(12) United States Patent
Katsumata

(10) Patent No.: US 8,152,935 B2
(45) **Date of Patent: *Apr. 10, 2012**

(54) VACUUM CARBURIZATION METHOD AND VACUUM CARBURIZATION APPARATUS

(75) Inventor: Kazuhiko Katsumata, Saitama (JP)

(73) Assignee: IHI Corporation (JP)

( * ) Notice: Subject to any disclaimer, the term of this patent is extended or adjusted under 35 U.S.C. 154(b) by 539 days.

This patent is subject to a terminal disclaimer.

(21) Appl. No.: 12/043,470

(22) Filed: Mar. 6, 2008

(65) Prior Publication Data

US 2008/0216922 A1 Sep. 11, 2008

(30) Foreign Application Priority Data

Mar. 9, 2007 (JP) ..... 2007-060498

(51) Int. Cl.
*C23C 8/20* (2006.01)
*C21D 1/773* (2006.01)

(52) U.S. Cl. ..... 148/223; 266/250

(58) Field of Classification Search ..... 148/223; 266/250

See application file for complete search history.

(56) References Cited

U.S. PATENT DOCUMENTS

| | | | | |
|---|---|---|---|---|
| 3,796,615 | A | 3/1974 | Westeren et al. | 148/16.5 |
| 4,191,598 | A | 3/1980 | Conybear et al. | 148/16.5 |
| 4,386,973 | A | 6/1983 | Kawka et al. | 148/16.5 |
| 2004/0187966 | A1* | 9/2004 | Yamaguchi et al. | 148/223 |
| 2007/0194504 | A1* | 8/2007 | Nakashima et al. | 266/104 |

FOREIGN PATENT DOCUMENTS

| | | |
|---|---|---|
| DE | 10243179 | 4/2004 |
| EP | 0 723 034 A2 | 7/1996 |
| JP | 48-14538 | 2/1973 |
| JP | 55-28391 | 2/1980 |
| JP | 61-117268 | 6/1986 |

(Continued)

OTHER PUBLICATIONS

English translation of an Office Action, issued by the State Intellectual Property Office, P.R. China, on the counterpart Chinese Patent Application No. 200810083406.5, dated Sep. 4, 2009 (8 pages).

(Continued)

*Primary Examiner* — Jessica L Ward
*Assistant Examiner* — Alexander Polyansky
(74) *Attorney, Agent, or Firm* — Ostrolenk Faber LLP

(57) ABSTRACT

There are provided a method, between a diffusion process and a quenching process, a normalizing process of performing step cooling in which a temperature lowering treatment and a temperature keeping treatment are alternately repeated plural times so that a temperature history from the first temperature to a predetermined temperature satisfies a predetermined condition; an after-normalizing maintaining process of maintaining the temperature of the whole workpiece for a predetermined time after the normalizing process so that the whole workpiece becomes the predetermined temperature, thereby producing fine crystal grains in the workpiece; and a reheating process of raising the temperature of the workpiece to the second temperature, after the after-normalizing keeping process. According to the invention, even when a process temperature is set high to make rapid progress of carburization and diffusion and thus the process time is shortened, uniformity in temperature is achieved between a surface and a inside of a workpiece by the high-temperature process and crystal grains are prevented from being coarse, thereby obtaining a workpiece having a predetermined property value.

9 Claims, 11 Drawing Sheets

FOREIGN PATENT DOCUMENTS

| | | | |
|---|---|---|---|
| JP | A-02-122062 | | 5/1990 |
| JP | 04-173917 | | 6/1992 |
| JP | 05-025554 | | 2/1993 |
| JP | 05279836 | A * | 10/1993 |
| JP | 06-010037 | | 1/1994 |
| JP | 06-100942 | | 4/1994 |
| JP | 06-172960 | | 6/1994 |
| JP | 8-325701 | | 12/1996 |
| JP | 09-263930 | | 10/1997 |
| JP | 11-036060 | | 2/1999 |
| JP | 11-118357 | | 4/1999 |
| JP | 2000-129418 | | 5/2000 |
| JP | 2001-098343 | | 4/2001 |
| JP | 2001-240954 | | 9/2001 |
| JP | 2001-272019 | | 10/2001 |
| JP | 2004-115893 | | 4/2004 |
| WO | WO 03/048405 | A1 | 6/2003 |

OTHER PUBLICATIONS

Japanese Office Action dated Jul. 7, 2009 (with English translation).
European Search Report dated Feb. 16, 2010 issued in corresponding European Patent No. 1905862 (7 pages).
An Office Action issued on Dec. 2, 2008 on counterpart Japanese Patent Application No. 2006-262525, with English translation (4 pages).

* cited by examiner

VACUUM CARBURIZATION METHOD AND VACUUM CARBURIZATION APPARATUS

BACKGROUND OF THE INVENTION

1. Field of the Invention

Priority is claimed on Japanese Patent Application No. 2007-060498, filed Mar. 9, 2007, the content of which is incorporated herein by reference.

The present invention relates to a vacuum carburization method and a vacuum carburization apparatus.

2. Description of the Related Art

Vacuum carburization is a carburization technique in which a surface layer of a metallic workpiece is carburized and quenched to enhance the hardness of the surface layer. Such vacuum carburization is described in Japanese Patent Application Laid-Open No. 8-325701 (hereinafter, referred to as Patent Document 1) and Japanese Patent Application Laid-Open No. 2004-115893 (hereinafter, referred to as Patent Document 2).

In the vacuum carburization described in Patent Document 1, a workpiece is vacuum-heated in a heating chamber to a predetermined temperature, carburizing gas such as acetylene is supplied into the heating chamber, and the workpiece is carburized. Then, the supply of the carburizing gas is stopped, the inside of the heating chamber is made into the vacuum state again, carbon on the surface of the workpiece is diffused thereinto, the temperature is lowered to a quenching temperature, and then an oil cooling is performed.

In the vacuum carburization described in Patent Document 2, in order to solve excessive carburization of a surface (particularly, a corner) of a workpiece, in the initial stage of the diffusion in the vacuum carburization described in Patent Document 1, a decarburizing gas is introduced into a furnace (equivalent to the heating chamber described in Patent Document 1), so that cementite in the surface layer of the workpiece is reduced or removed.

FIGS. 12 and 13 are diagrams illustrating a treatment time and a temperature of each process of the conventional vacuum carburization, an atmosphere condition, and examples of apparatus types when a ring gear for automobile is processed. In this processing, a steel material such as SCr420 with a basic material carbon concentration of 0.2% is used as a workpiece, a target surface carbon concentration is 0.8%, an effective carburization depth is 0.8 mm in FIGS. 12 and 1.5 mm in FIG. 13, and a target carbon concentration at the effective carburization depth is 0.35%.

In the conventional vacuum carburization described above, as shown in FIGS. 12 and 13, after the diffusion process, the temperature is lowered to the quenching temperature in the temperature lowering process, and then the process is transferred to a maintaining process before quenching. In this case, generally the carburization temperature X° C. is about 930° C. Since the rate of the carburization and the diffusion gets higher as the treatment temperature gets higher, it is possible to shorten the time for the vacuum carburization.

However, when the vacuum carburization is performed, for example, at the treatment temperature X° C. of 1050° C., it is difficult to form fine crystal grains in the workpiece W due to bloating caused by the high temperature treatment. Accordingly, it is difficult to obtain a workpiece W having a predetermined property value. In addition, non-uniformity in temperature occurs between the surface and the inside of the workpiece and thus the crystal grains become non-uniform.

The invention has been made to solve the aforementioned problems, and an object of the invention is to raise the treatment temperature to allow rapid progress of the carburization and the diffusion, achieve uniformity in temperature between the surface and the inside of the workpiece even when the treatment time is shortened, and to solve the problem of the crystal grains being bloated, thereby obtaining a workpiece having a predetermined property value.

SUMMARY OF THE INVENTION

In order to solve the aforementioned problems, according to a first aspect of the invention, there is provided a vacuum carburization method comprising: a preheating process of heating a workpiece in a heating chamber to a first temperature; a carburizing process of supplying carburizing gas into the heating chamber to carburize the workpiece in a state where the inside of the heating chamber is depressurized into an extremely low pressure; a diffusion process of stopping the supply of the carburizing gas to diffuse carbon from the surface of the workpiece to the inside thereof; and a quenching process of quenching the workpiece from a state where the workpiece is made to a second temperature, the method further comprising: between the diffusion process and the quenching process, a normalizing process of performing step cooling in which a temperature lowering treatment and a temperature maintaining treatment are alternately repeated plural times so that a temperature history from the first temperature to a predetermined temperature satisfies a predetermined condition; an after-normalizing maintaining process of maintaining the temperature of the whole workpiece for a predetermined time after the normalizing process so that the whole workpiece reaches the predetermined temperature, thereby producing fine crystal grains in the workpiece; and a reheating process of raising the temperature of the workpiece to the second temperature, after the after-normalizing keeping process.

According to a second aspect of the invention, in the vacuum carburization method according to the first aspect of the invention, lowering temperatures in temperature lowering treatments of the normalizing process may be equivalently set.

According to a third aspect of the invention, in the vacuum carburization method according to the first or second aspect of the invention, the carburizing process, the diffusion process, the normalizing process, and the reheating process may be performed in the heating chamber.

According to a fourth aspect of the invention, in the vacuum carburization method according to any one of the first to third aspects of the invention, the quenching process may be performed in a cooling chamber for cooling the workpiece provided separately from the heating chamber.

According to a fifth aspect of the invention, in the vacuum carburization method according to any one of the first to fourth aspects of the invention, the preheating process, the diffusion process, and the reheating process may be performed in a state where the heating chamber is depressurized into an extremely low pressure state or in a state where the heating chamber is filled with inert gas.

According to a sixth aspect of the invention, there is provided a vacuum carburization apparatus comprising: a heating chamber having a heater; and a cooling chamber having a first cooler, wherein the heater heats a workpiece in the heating chamber to a first temperature, carburizing gas is supplied into the heating chamber to carburize the workpiece in a state where the inside of the heating chamber is depressurized lower than a predetermined pressure, the supply of the carburizing gas is stopped to diffuse carbon from the surface to the inside of the workpiece, and the workpiece is quenched in the cooling chamber by the first cooler in a state where the workpiece is set to a second temperature, wherein the heating chamber includes: a furnace surrounded by a heat insulating partition wall; a second cooler having a first gas convection device disposed at least in the furnace; and a wind-path switching mechanism for circulating the gas in the heating chamber at an opening position and convecting the gas in the furnace at a closing position.

According to a seventh aspect of the invention, in the vacuum carburization apparatus according to the sixth aspect of the invention, the second cooler may include the first gas convection device and a heat exchanger provided in the heating chamber.

According to an eighth aspect of the invention, in the vacuum carburization apparatus according to the sixth or seventh aspect of the invention, the first gas convection device may be a centrifugal fan, and the wind-path switching mechanism may have a first door provided in a part of the heat insulating partition wall of the furnace in a gas output direction of the centrifugal fan, and a second door provided in the heat insulating partition wall opposite to the first door with the workpiece interposed therebetween.

According to a ninth aspect of the invention, in the vacuum carburization apparatus according to any one of the sixth to eighth aspects of the invention, the first gas convection device may lower the temperature of the carburized workpiece from the first temperature to a predetermined temperature so that a temperature history thereof satisfies a predetermined condition, and the temperature of the workpiece is kept so that the temperature of the whole workpiece reaches the predetermined temperature, thereby producing fine crystal grains in the workpiece.

According to a tenth aspect of the invention, there is provided a vacuum carburization apparatus comprising a heating chamber having a heater and a cooler, wherein the heater heats a workpiece in the heating chamber to a first temperature, carburizing gas is supplied into the heating chamber to carburize the workpiece in a state where the inside of the heating chamber is depressurized lower than a predetermined pressure, the supply of the carburizing gas is stopped to diffuse carbon from the surface to the inside of the workpiece, and the workpiece is quenched by the cooler in a state where the workpiece is set to a second temperature, wherein the heating chamber includes: a furnace surrounded by a heat insulating partition wall; a first gas convection device disposed in the furnace; and a wind-path switching mechanism for circulating the gas in the heating chamber at an opening position to cool the workpiece and convecting the gas in the furnace at a closing position.

According to an eleventh aspect of the invention, in the vacuum carburization apparatus according to any one of the sixth to tenth aspects of the invention, the heater may have a heating member made of conductive materials to endure quenching from a high temperature state and disposed in the furnace, and a support member attached to the heat insulating partition wall of the furnace to support and fix the heating member to the heat insulating partition wall of the furnace, a current measuring mechanism may be disposed to measure a ground-fault current of the heating member outside the heating chamber, and whether a ground fault of the heating member occurs or not may be detected from the value measured by the current measuring mechanism.

According to a twelfth aspect of the invention, in the vacuum carburization apparatus according to any one of the sixth to eleventh aspects of the invention, the cooler may circulate high-pressure gas to cool the workpiece.

According to a thirteenth aspect of the invention, in the vacuum carburization apparatus according to any one of the sixth to twelfth aspects of the invention, the heating chamber may have a second gas convection device.

According to the vacuum carburization method of the invention, since the temperature maintenance is performed in the after-diffusion normalizing process and thereafter, it is possible to produce fine crystal grains in the workpiece by the temperature maintenance in the normalizing process and the temperature maintenance thereafter, even when the crystal grains are made coarse by performing the carburizing and the diffusion with a high temperature in order to shorten the process time. Particularly, in the normalizing after the diffusion, the step cooling process is performed in which the temperature lowering process and the temperature maintaining process are alternately repeated to lower the temperature of the workpiece, the temperature of the whole workpiece becomes uniform, and thus it is possible to suppress the non-uniformity between the surface temperature and the internal temperature of the workpiece generated at the time of cooling. Accordingly, it is possible to further uniformly produce fine crystal grains in the workpiece. For this reason, while shortening the process time by the high-temperature process, the crystal grains of the workpiece are prevented from becoming coarse due to the high-temperature process. Therefore, it is possible to obtain the workpiece having a predetermined property value, thereby securing a predetermined quality.

According to the invention, since the reheating and quenching are performed after the normalizing, it is possible to efficiently complete the vacuum carburization.

According to the vacuum carburization apparatus of the invention, since the first gas convection device is provided in the furnace of the heating chamber, it is possible to promptly and uniformly change the temperature in the furnace, using the radiant heat generated in the furnace and the forcible convective heat generated by the first gas convection device. For this reason, it is possible to shorten the process time in the temperature raising.

In addition, the furnace is provided with the wind-path switching mechanism, which circulates the gas in the heating chamber at the opening position to cool the workpiece and convects the gas in the furnace at the closing position. Accordingly, it is possible to easily control the temperature in the maintaining process, by opening and closing the wind-path switching mechanism. Particularly, since the heater is necessary to maintain the temperature, it is necessary to continuously perform the cooling and the heating in order to maintain the temperature after the normalizing. The first gas convection device is provided in the furnace of the heating chamber, thereby easily performing the continuous cooling and heating. For this reason, after performing the step cooling in the normalizing process, it is possible to easily perform the precise temperature control in the cooling process and the temperature maintaining process with high precision.

DETAILED DESCRIPTION OF THE INVENTION

Figure 1:
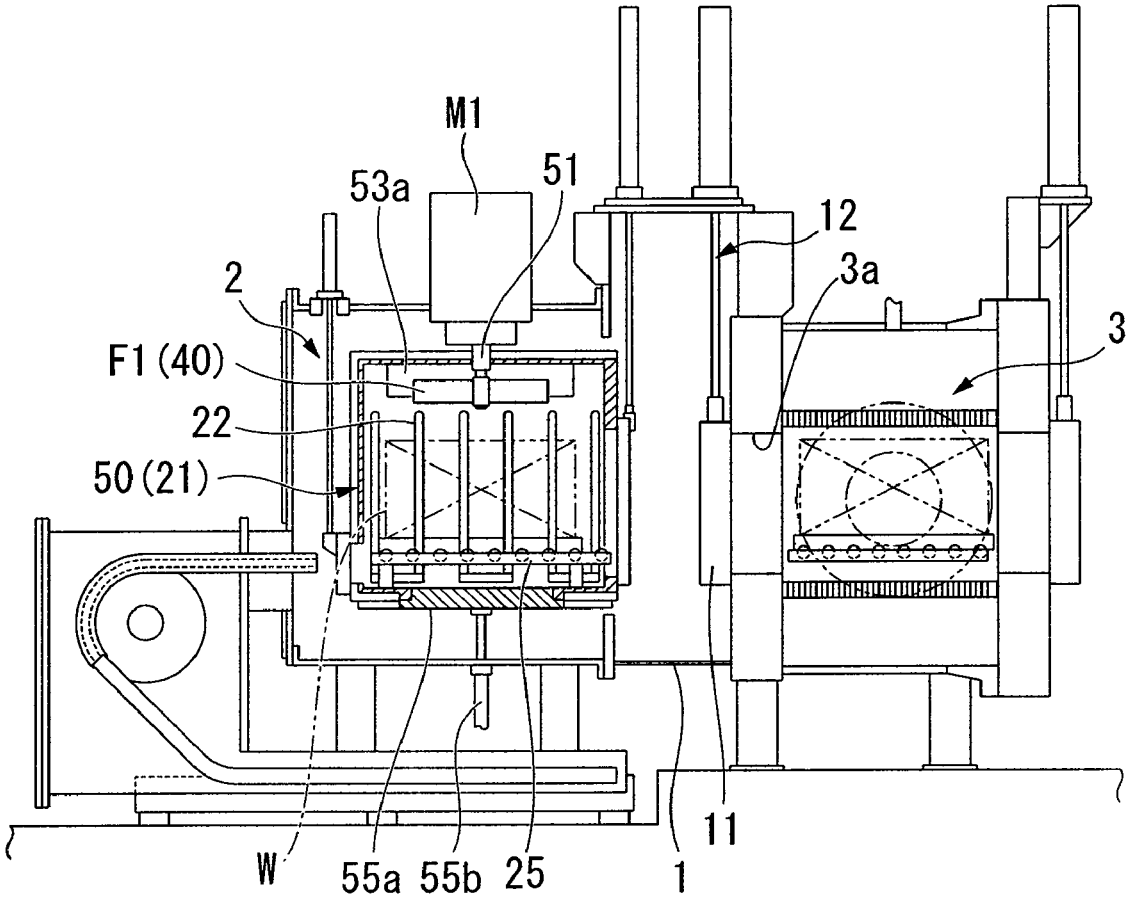
FIG. 1 is a front view illustrating a configuration of a vacuum carburization apparatus according to an embodiment of the invention.

Hereinafter, an embodiment of a vacuum carburization apparatus and a vacuum carburization method according to the invention will be described with reference to the drawings. In the drawings, the scale of each of the members is appropriately modified for ease of viewing.

Figure 2:
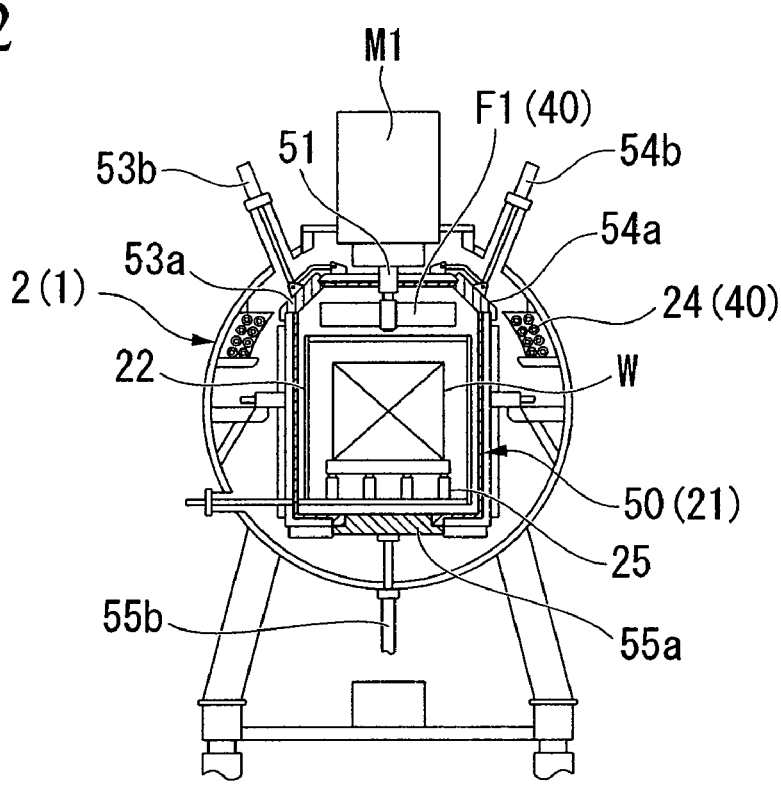
FIG. 2 is a left side view of FIG. 1.
Figure 3:
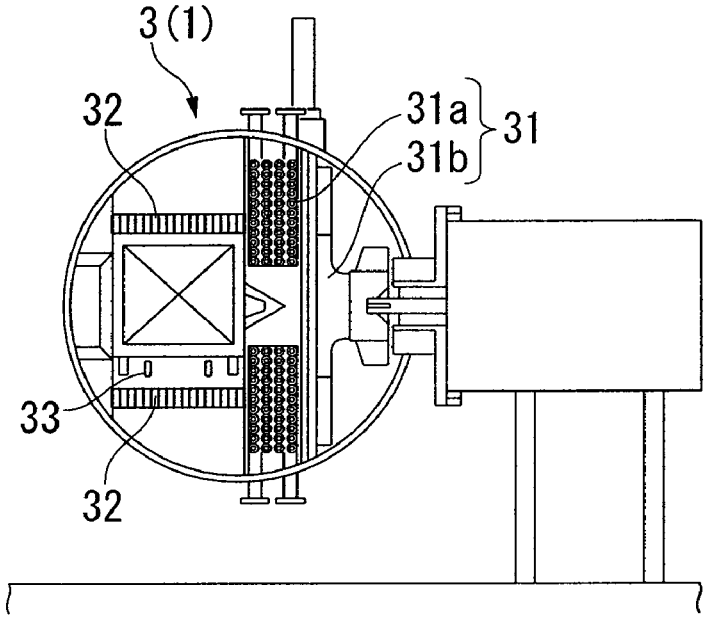
FIG. 3 is a right side view of FIG. 1.

FIGS. 1 to 3 are sectional views illustrating a configuration of a vacuum carburization apparatus according to the embodiment, where FIG. 1 is a front view, FIG. 2 is a left side view, and FIG. 3 is a right side view. As shown in FIGS. 1 to 3, the vacuum carburization apparatus according to the embodiment includes a case 1, a heating chamber 2, and a cooling chamber 3. The vacuum carburization apparatus is a two-chamber type in which heating and cooling processes are performed in separate chambers, respectively. The case 1 has a substantially cylindrical shape, and the case 1 is installed so that an axis thereof is horizontal. The case 1 is divided at a substantially middle thereof in an axial direction, in which the heating chamber 2 is housed in one side of the case 1 and the other side is the cooling chamber 3. At the substantially middle of the case 1 in the axial direction, there is provided an opening and closing mechanism 12 to open and close the cooling chamber 3 by moving up and down a door 11 closing an inlet 3*a* of the cooling chamber 3.

Figure 4:
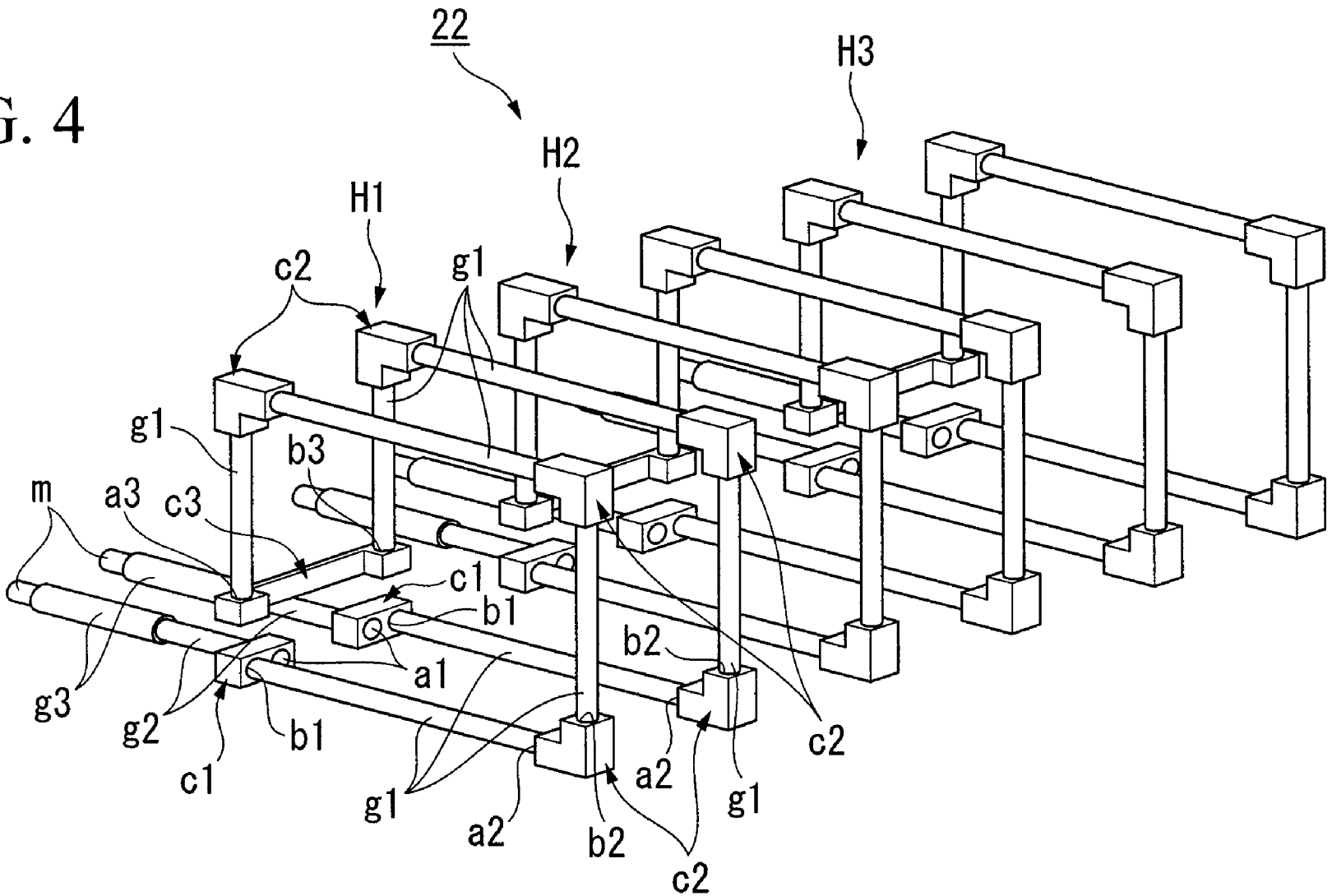
FIG. 4 is a perspective view illustrating a shape of a heater according to an embodiment of the invention.
Figure 5:
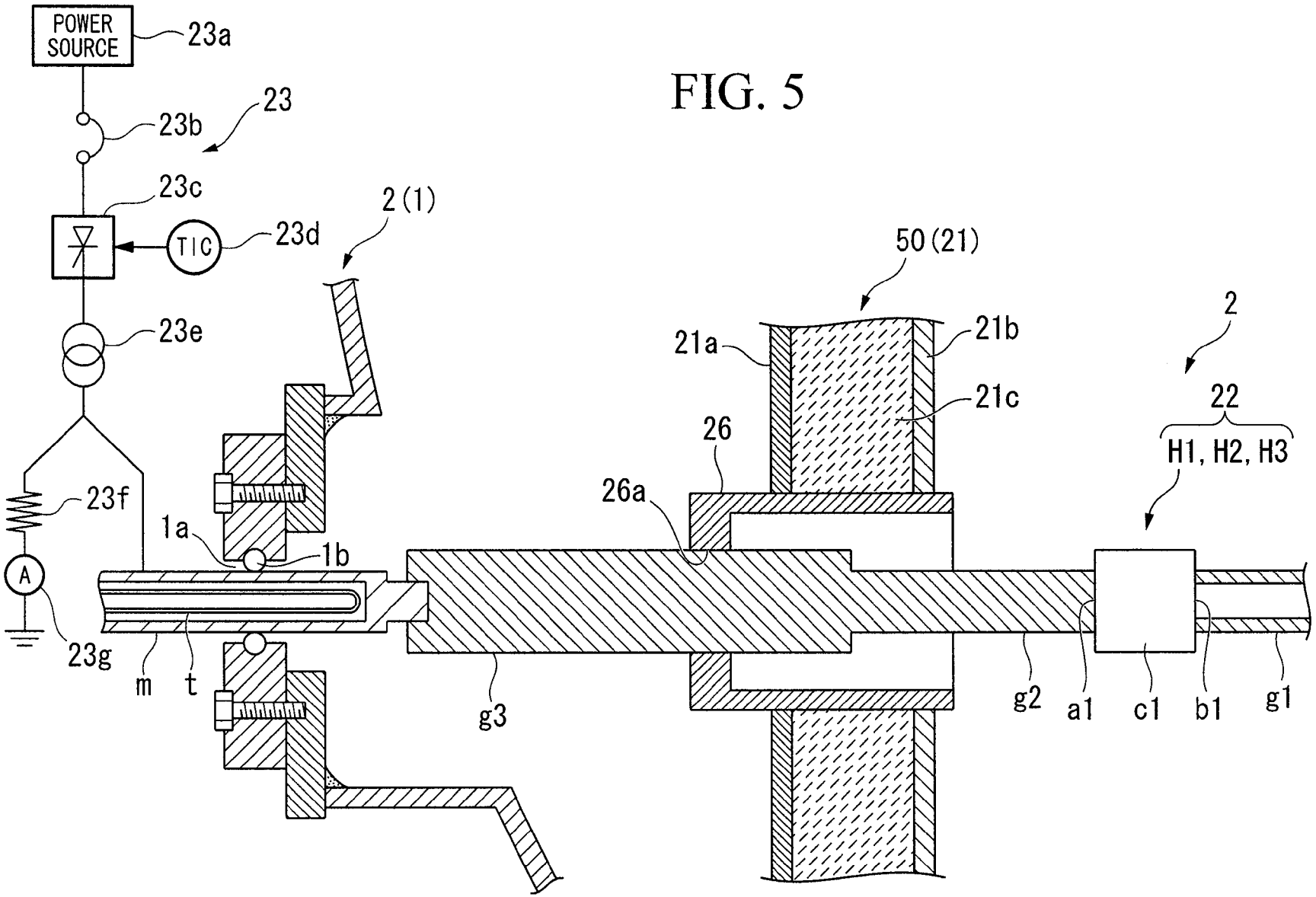
FIG. 5 is a schematic view illustrating a structure of connecting a heater 22 of a furnace 50 to a heat insulating partition wall 21 and illustrating electrical connection between the heater 22 and a power supply portion 23 according to an embodiment of the invention.

The heating chamber 2 includes a furnace 50, a heater 22, a power supply portion 23, and a base 25. FIG. 4 is a perspective view illustrating a shape of the heater 22. FIG. 5 is a schematic view illustrating a structure of attaching the heater 22 to the furnace 50 and illustrating electrical connection between the heater 22 and the power supply portion 23.

As shown in FIG. 5, the furnace 50 is formed of a box-shaped heat insulating partition wall 21 filled with a heat insulating material 21*c* between a metallic outer shell 21*a* and a graphite inner shell 21*b*.

As shown in FIG. 4, the heater 22 includes three same-shaped heaters H1 to H3. Each of the heaters H1 to H3 includes hollow thin shafts g1, full thin shafts g2, full thick shafts g3, connectors c1 to c3, and feed shafts m. The hollow thin shaft g1, the full thin shaft g2, and the full thick shaft g3 are made of graphite. The feed shaft m is made of metal.

The connector c1 is a rectangular parallelepiped and includes connection portions a1 and b1 having directions different from each other in each of regions divided into two equal parts in a longitudinal direction. The hollow thin shaft g1 and the full thin shaft g2 are electrically connected to each other by the connector c1. The connector c2 has an L shape in which two connection portions a2 and b2 are perpendicular to each other. The hollow thin shafts g1 are electrically connected to each other by the connector c2. The connector c3 is formed by separately connecting two connection portions a3 and b3 having the same direction. The hollow thin shafts g1 are electrically connected to each other by the connector c3.

The four hollow thin shafts g1 are disposed to form a rectangle, and three corners of the rectangle are connected by the connectors c2. One of ends of the two hollow thin shafts g1 forming the other one corner c2 of the rectangle is connected to the full thin shaft g2 by the connector c1, and the other is attached to any one of the connection portions a3 and b3 of the connector c3. The end opposite to the end of the full thin shaft g2 connected to the connector c1 continues to one end of the full thick shaft g3, and the feed shaft m is attached to the other end of the full thick shaft 3.

The configuration composed of the four hollow thin shafts g1, the full thin shaft g2, the full think shaft g3, the connector c1, the three connectors c2, and the feed shaft m makes a pair, and the pair is connected to the other pair by the connector c3 to form each of the heaters H1 to H3.

The hollow thin shaft g1, the full thin shaft g2, and the full thick shaft g3 are configured to have different heating properties depending on a difference in cross sectional areas. The heating properties are good in an order of the hollow thin shaft g1, the full thin shaft g2, and the full thick shaft g3, and it is difficult for the full thick shaft g3 to generate heat.

As shown in FIG. 5, the feed shaft m is hollow, and a cooling pipe t is housed therein. In the cooling pipe t, cooling water circulates to prevent a temperature rise due to application of electric current.

The heaters H1 to H3 are supported by a heater supporter 26 provided at a part of the heat insulating partition wall 21 of the furnace 50. The heater supporter 26 is made of ceramic and has a substantially cylindrical shape in which an inner diameter thereof is larger than a diameter of the full thick shaft g3. The heater supporter 26 is fixed so that an axial direction of the cylindrical shape is parallel to a thickness direction of the heat insulating partition wall 21 and ends thereof are located inside and outside the heat insulating partition wall 21.

The end located outside the heat insulating partition wall 21 has an opening 26*a* having the same diameter as the diameter of the full thick shaft g3 smaller than the inner diameter of the cylindrical shape, and the full thick shaft g3 is fitted to the opening 26*a* to support the heaters H1 to H3.

The feed shaft m is drawn out from an opening 1*a* of the case 1 to the outside of the case 1. A gap between the opening 1*a* and the feed shaft m is filled and sealed by a sealing member 1*b*. The feed shaft m is connected to the power supply portion 23.

The power supply portion 23 includes a power supply 23*a*, a breaker 23*b*, a thyristor 23*c*, a temperature controller 23*d*, a transformer 23*e*, a resistor 23*f*, and an ammeter 23*g*.

The power supply 23*a* is connected to the feed shaft m through the breaker 23*b*, the thyristor 23*c*, and the transformer 23*e*, and supplies electric power to the feed shaft m. When a load to a circuit is over a permissible range, the breaker 23*b* breaks the electric power to prevent an overload of the circuit.

The thyristor 23*c* allows the circuit to be in an active state in cooperation with the temperature controller 23*d* until the temperature of the heaters H1 to H3 reaches a predetermined temperature, and the thyristor 23*c* allows the circuit to be in an inactive state when the temperature of the heaters H1 to H3 reaches the predetermined temperature. The transformer 23*e* transforms the voltage of the electric power supplied from the power supply 23*a* into a predetermined value.

The resistor 23*f* and the ammeter 23*g* are divided from the circuit between the transformer 23*e* and the feed shaft m, and the resistor 23*f* and the ammeter 23*g* are disposed in the course of the grounded circuit. The ammeter 23*g* measures a ground-fault current.

As shown in FIGS. 1 and 2, a motor M1 is downwardly provided above the heating chamber 2. A shaft 51 of the motor M1 passes from the upper surface of the furnace 50 into the furnace 50. A fan F1 (first gas convection device) is attached to an end of the shaft 51.

The fan F1 is a centrifugal fan and is disposed along the upper surface in the furnace 50.

Doors 53*a* and 54*a* (first door) are provided on both sides of the upper surface of the furnace 50, which is a gas output side of the fan F1 (see FIG. 2 for reference). A door 55*a* (second door) is provided on the lower surface of the furnace 50 with the workpiece W interposed therebetween. The doors 53*a*, 54*a*, and 55*a* are connected to cylinders 53*b*, 54*b*, and 55*b*, respectively, and are formed of an openable and closable wind-path switching mechanism. That is, when the doors 53*a*, 54*a*, and 55*a* are at an opening position, the furnace 50 and the heating chamber 2 communicate with each other and the fan F1 is driven, thereby circulating flowing gas in the whole heating chamber 2. In a vacuum state, as the temperature increases, a material with a lower vapor pressure first evaporates. Accordingly, a fan made of materials which are not thermally transformed even when the temperature in the furnace 50 is raised to about 1300° C., is used as the fan F1 exposed to a high temperature in the furnace 50.

A heat exchanger 24 is provided outside the furnace 50 along the inner wall of the heating chamber 2. The heat exchanger 24 takes heat from the gas heated in the furnace 50 to perform cooling (see FIG. 2 for reference).

In order to improve cooling efficiency, in addition to such a cooler 24, for example, there may be provided a water cooling jacket for cooling gas by allowing cooling water to pass through a water passage provided in the case 1, or an air cooling fin for cooling gas may be provided outside the case 1 using a widened heating area thereof.

When the inside of the heating chamber 2 is cooled, the doors 53*a*, 54*a*, and 55*a* of the furnace 50 are opened; the gas in the furnace 50 and the heating chamber 2 is circulated by the fan F1 and is cooled by the heat exchanger 24 to lower the temperature in the heating chamber 2 and the temperature of the workpiece W in the furnace 50. As described above, when the inside of the heating chamber 2 is cooled, the fan F1 together with the heat exchanger 24 is configured as a second cooler 40.

The base 25 includes a rectangular frame and a plurality of rollers. Each of the rollers has a rotational axis arranged parallel to two opposed sides of the frame, and both ends thereof are rotatably supported to the other two sides of the frame. The base 25 is installed so that the rotational axis of the roller is perpendicular to a conveying direction, thereby reliably conveying the workpiece W. The workpiece W is placed on the base 25 to uniformly heat the workpiece W from the lower surface thereof.

The aforementioned portions are made of materials which are not thermally deformed even when the temperature in the furnace 50 is raised to about 1300°, as well as the fan F1.

As shown in FIG. 3, the cooling chamber 3 is a chamber for cooling the workpiece W, and the cooling chamber 3 includes a first cooler 31, an arranging plate 32, and a base 33.

The first cooler 31 includes a heat exchanger 31*a* and a fan 31*b*. The heat exchanger 31*a* takes heat from the gas in the cooling chamber 3 to perform cooling. The fan 31*b* circulates gas at a high pressure in the cooling chamber 3.

The arranging plate 32 is a lattice box divided in a lattice shape and is disposed upside and downside of a position where the workpiece W is to be placed in the cooling chamber 3 to arrange a flow direction of the gas in the cooling chamber 3. The base 33 has substantially the same structure as the base 25 installed in the heating chamber 2. The base 33 is disposed at the same height as the base 25. The lattice box may be formed of combination of a lattice box and a punching metal.

Next, vacuum carburization using the vacuum carburization apparatus with such a configuration will be described with reference to FIGS. 6 to 8. In the vacuum carburization, a preheating process, a before-carburizing maintaining process, a carburizing process, a diffusion process, a normalizing process, a reheating process, a before-quenching keeping process, and a quenching process are sequentially performed in such an order.

Figure 6:
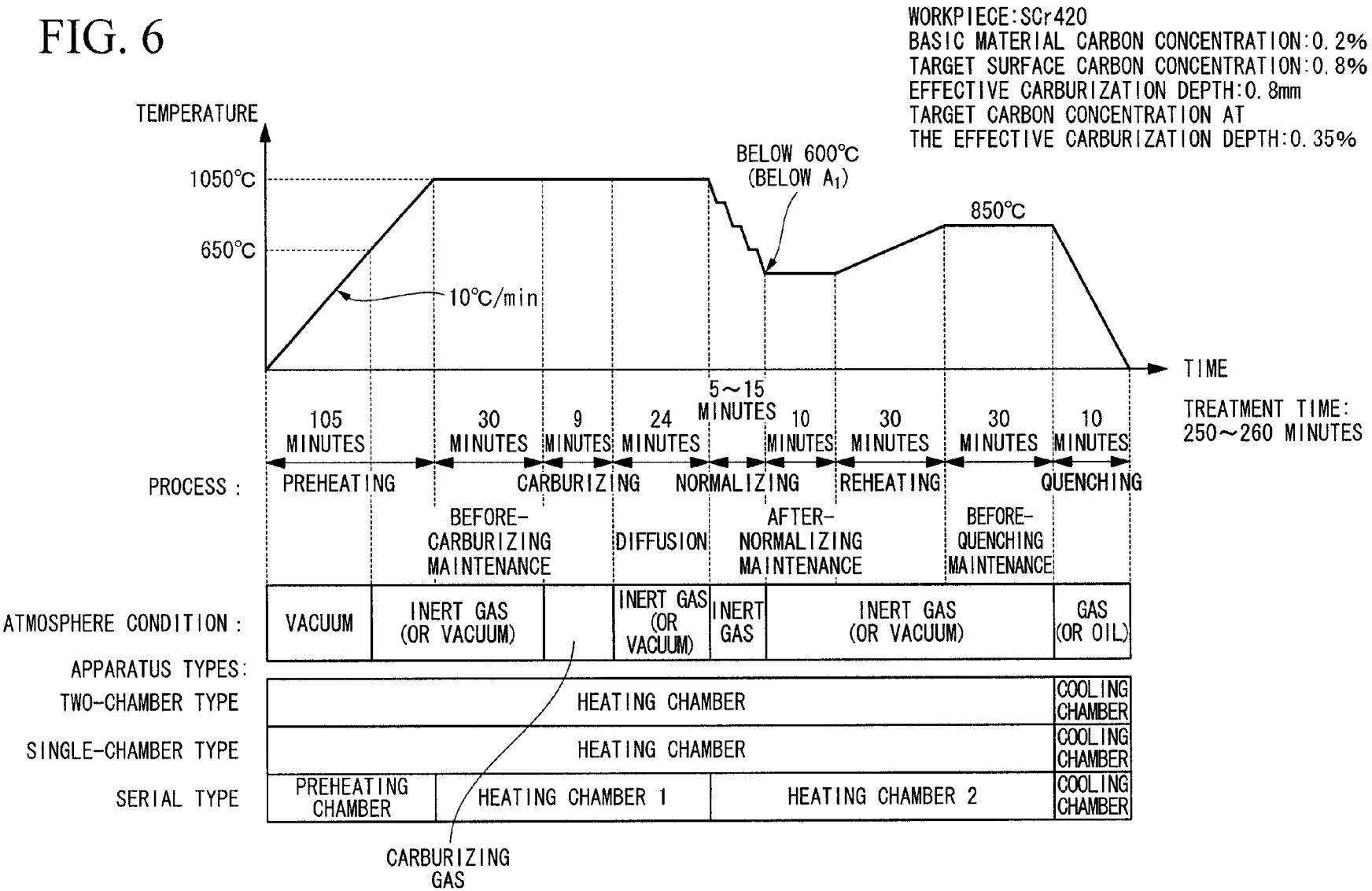
FIG. 6 is a diagram illustrating a treatment time and a temperature in each process of vacuum carburization, an atmosphere condition, and examples of apparatus types according to an embodiment of the invention.

FIG. 6 is a diagram illustrating a treatment time and a temperature in each process, an atmosphere condition, and examples of apparatus types according to an embodiment of the invention, where a steel material such as SCr420 having a basic material carbon concentration of 0.2% is used as a workpiece material; a target surface carbon concentration is 0.8%; an effective carburization depth is 0.8 mm; and a target carbon concentration in the effective carburization depth is 0.35%. FIG. 7 is an enlarged diagram illustrating the normalizing process shown in FIG. 6, where a vertical axis represents a temperature and a horizontal axis represents a process time. FIG. 8 is an enlarged diagram for comparison illustrating the normalizing process similarly with FIG. 7, where a vertical axis represents a temperature and a horizontal axis represents a process time.

The process time of each process described in the diagram above is calculated by the diffusion equation using Fick's second law.

In the preheating process, the workpiece W is first placed at a position surrounded by the heaters H1 to H3 provided in the furnace 50 of the heating chamber 2. Subsequently, gas is discharged from the heating chamber 2 to depressurize the inside of the heating chamber 2 and the inside of the furnace 50, thereby forming in a vacuum state. In the general vacuum carburization, "vacuum" means a state of about 10 kPa or less, that is, 1/10 atmospheric pressure. However, in the embodiment, a state of 1 Pa or less is considered as a "vacuum". At this time, the doors 53*a*, 54*a*, and 55*a* of the wind-path switching mechanism are closed to block the inside of the furnace 50.

Next, an electric current is applied to the heater 22 to raise the temperature in the furnace 50. It is possible to perform the vacuum carburization process even when the whole preheating process is performed in the vacuum state. However, in the embodiment, the temperature in the heating chamber 2 is raised to 650° C., and the heating chamber 2 is filled with inert gas to prevent materials from being evaporated from the surface of the workpiece W. At this time, the air pressure in the heating chamber 2 is in the range of about 0.1 kPa to the atmospheric pressure, or less. The fan F1 is driven to efficiently raise the temperature in the furnace 50, by using both radiant heat generated by raising the temperature in the furnace 50 and forcible convective heat generated by the fan F1. When the temperature in the heating chamber 2 reaches 1050° C. by continuously raising the temperature, the process is transferred to the before-carburizing maintaining process.

In the before-carburizing maintaining process, the temperature in the heating chamber 2 is kept at the finishing temperature of the preheating process. According to the before-carburizing maintaining process, the temperature of the workpiece W becomes uniform at 1050° C. (first temperature) from the surface to the inside thereof. For the last 2 minutes in the before-carburizing maintaining process, the inert gas is discharged to depressurize the inside of the heating chamber 2, thereby returning to the vacuum state.

In the carburizing process, the heating chamber 2 is filled with carburizing gas. The carburizing gas is, for example, acetylene. At this time, the air pressure in the heating chamber 2 is 0.1 kPa or less. In the carburizing process, the workpiece W is placed under the atmosphere of a high-temperature carburization gas such as 1050° C. to carburize the workpiece W in the heating chamber 2.

In the diffusion process, the carburizing gas in the heating chamber 2 is discharged and the heating chamber 2 is filled with inert gas. At this time, the air pressure in the heating chamber 2 is in the range of 0.1 kPa to the atmospheric pressure, or less. Then, the temperature in the heating chamber 2 is maintained. According to the diffusion process, carbon close to the surface of the workpiece W is diffused from the surface to the inside of the work W.

When the process temperature is under the same condition, a surface carbon concentration, an effective carburization depth, and a carbon concentration in the effective carburization are determined on the basis of a process time of the carburizing process and a process time of the diffusion process.

After the diffusion process, the normalizing process is performed. Before the normalizing process, the workpiece W is exposed to the high temperature such as 1050° C. Accordingly, the crystal grains become large. The normalizing process is performed to produce fine crystal grains, in which cooling is performed for a predetermined time (e.g., 5 to 15 minutes) so that the temperature in the furnace 50 becomes from 1050° C. to 600° C. or less.

Figure 8:
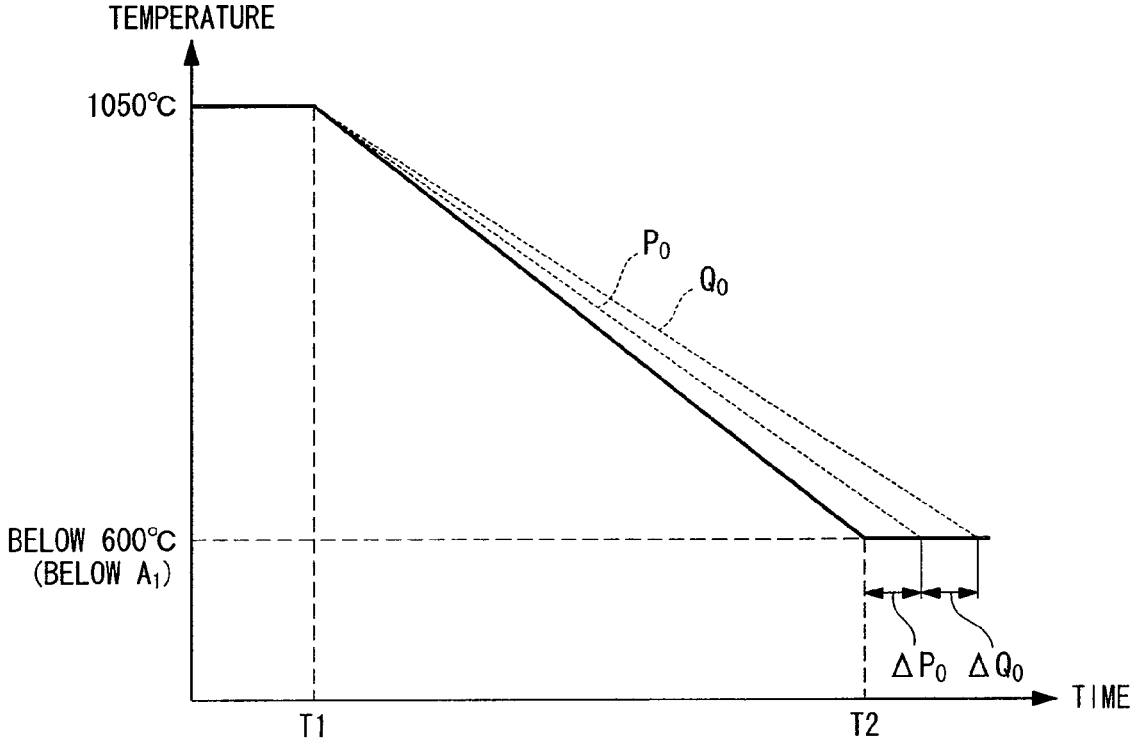
FIG. 8 is a diagram illustrating a treatment time and a temperature in a normalizing process as compared with FIG. 7.

In the normalizing process as shown in FIG. 8, generally, only cooling is performed for a predetermined time (e.g., between T1 to T2) so that the temperature in the furnace 50 is continuously dropped to 600° or less. However, when the cooling is continuously performed, the surface temperature ($P_0$ in FIG. 8) of the workpiece W and the internal temperature ($Q_0$ in FIG. 8) do not become equal to each other and thus non-uniformity occurs. Therefore, a significantly large error occurs between real temperatures of the workpiece W, in comparison with an ideal temperature slope (solid line in FIG. 8) of the furnace 50. At the starting time T2 of the after-normalizing maintaining process after the normalizing process, a delay occurs in temperature drop of the temperature in the furnace 50, the surface temperature of the workpiece W, and the internal temperature thereof (e.g., $\Delta P_0$ and $\Delta Q_0$). As a result, even when a temperature keeping process is performed in the after-normalizing maintaining process as it stands, the crystal grains are not made sufficiently fine.

For this reason, as shown in FIGS. 6 and 8, in the normalizing process, a step cooling process is performed in which a cooling process and a maintaining process are alternately repeated at the time of cooling from 1050° C. to 600° C. or less.

Specifically, the fan F1 provided in the furnace 50 is continuously driven, and the doors 53*a*, 54*a*, and 55*a* of the wind-path switching mechanism are set to the opening positions to open the furnace 50 at the time of cooling, thereby allowing the gas in the heating chamber 2 to pass through the heat exchanger 24 and to circulate and cool the carburized workpiece W. Meanwhile, the doors 53*a*, 54*a*, and 55*a* of the wind-path switching mechanism are set to the closing position to close the furnace 50 at the time of temperature maintaining, thereby allowing the gas to convect in the furnace 50. Accordingly, the whole workpiece W has a uniform temperature.

As described above, the cooling and the temperature maintaining are set as 1 cycle, and the cycles are repeated plural times (e.g., 3.5 cycles) for a predetermined process time (e.g., between T1 to T2) so that the inside of the furnace 50 is cooled to 600° C. or less. Thus, the non-uniformity between the surface temperature ($P_1$ in FIG. 7) and the internal temperature ($Q_1$ in FIG. 7) of the workpiece W disappears at every time of the temperature maintaining. For this reason, it is possible to suppress the non-uniformity between the surface temperature and the internal temperature of the workpiece W. In addition, at the starting time T2 of the after-normalizing maintaining process, it is possible to suppress the delay in temperature drop of the temperature in the furnace 50, the surface temperature of the workpiece W, and the internal temperature thereof (e.g., $\Delta P_1$ and $\Delta Q_1$).

Figure 7:
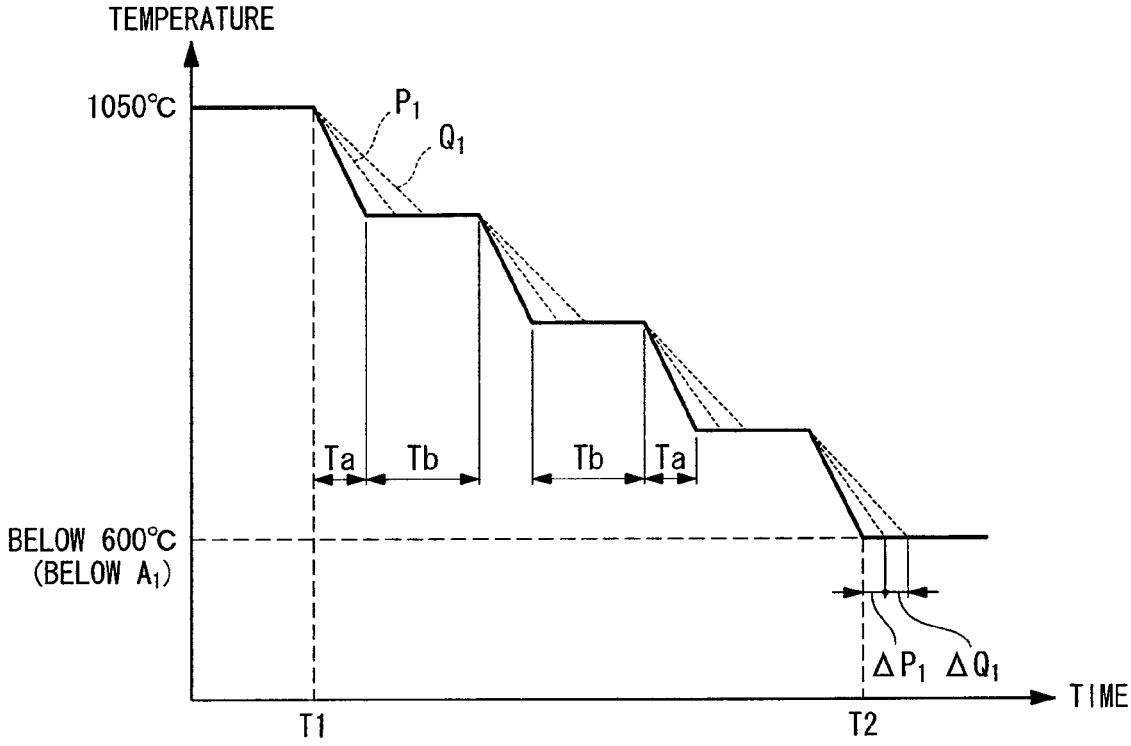
FIG. 7 is a diagram illustrating a treatment time and a temperature of step cooling in a normalizing process shown in FIG. 6.

In order to prevent the non-uniformity between the surface temperature and the internal temperature of the workpiece W with high precision, it is preferable that the cooling temperature of each cycle at the step cooling be set uniformly (e.g., in FIG. 7, change in temperature of each cooling cycle is set to (1050-600)/4(° C.)). Further, it is preferable that the cooling time (e.g., Ta in FIG. 7) or the temperature maintaining time (e.g., Tb in FIG. 7) of each cycle be set uniformly. The number of cycles of the cooling and the temperature maintaining may be appropriately modified.

Subsequently, the after-normalizing maintaining process is performed. In the after-normalizing maintaining process, the temperature is maintained for a predetermined time (e.g. 10 minutes) to make the temperature of the whole workpiece W uniform, thereby further fining the crystal grains.

In the reheating process, the temperature in the furnace 50 lowered in the normalizing process is raised again. In the reheating process, the temperature is raised to 850° C. (second temperature), which is a quenching temperature in the quenching process thereafter. This temperature is maintained in the before-quenching maintaining process for a predetermined time. According to the before-quenching maintaining process, the temperature of the workpiece W become uniform as 850° C. from the surface to the inside thereof.

Lastly, the workpiece W is transferred to the cooling chamber 3 and then the quenching process is performed. In the quenching process, the workpiece W is cooled by the first cooler 31. In order to cool the workpiece, that is, a difficult quenching material such as a steel material of SCr420, it is necessary that the cooling be performed by a half temperature difference in cooling within the initial 1 minute of the process time. The first cooler 31 performs the cooling while circulating the gas in the cooing chamber 3, for example, at a pressure higher than the atmospheric pressure by 10 to 30 times, thereby improving a cooling rate of the workpiece W.

According to the vacuum carburization of the invention as compared with the conventional vacuum carburization, since the temperature maintaining is performed in the after-diffusion normalizing process and thereafter, it is possible to produce fine crystal grains in the workpiece W by the temperature maintaining in the normalizing process and the temperature maintaining thereafter, even when the crystal grains are made coarse by performing the carburizing and the diffusion with a high temperature in order to shorten the process time. Particularly, in the normalizing after the diffusion, the step cooling is performed in which the temperature lowering process and the temperature maintaining process are alternately repeated to lower the temperature of the workpiece W, the temperature of the whole workpiece W becomes uniform, and thus it is possible to suppress the non-uniformity between the surface temperature and the internal temperature of the workpiece W generated at the time of cooling. Accordingly, it is possible to further uniformly produce fine crystal grains of the workpiece W. For this reason, while shortening the process time by the high-temperature process, the crystal grains of the workpiece W are prevented from becoming coarse due to the high-temperature process. Therefore, it is possible to obtain the workpiece W having a predetermined property value, thereby securing a predetermined quality.

According to the invention, since the reheating and quenching are performed after the normalizing, it is possible to efficiently complete the vacuum carburization.

According to the vacuum carburization apparatus of the invention, since the fan F1 is provided in the furnace 50 of the heating chamber 2, it is possible to promptly and uniformly change the temperature in the furnace 50, using the radiant heat generated in the furnace 50 and the forcible convective heat generated by the fan F1. For this reason, it is possible to shorten the process time in the temperature raising. In addition, the furnace 50 is provided with the wind-path switching mechanism, which circulates the gas in the heating chamber 2 at the opening position to cool the workpiece W and convects the gas in the furnace 50 at the closing position. Accordingly, it is possible to easily control the temperature in the maintaining process, by opening and closing the doors 53*a*, 54*a*, and 55*a* of the wind-path switching mechanism. Particularly, since the heater 22 is necessary to keep the temperature, it is necessary to continuously perform the cooling and the heating in order to maintain the temperature after the normalizing. The fan F1 as the second cooler 40 is provided in the furnace 50 of the heating chamber 2 and the heat exchanger 24 is provided, thereby easily performing the continuous cooling and heating. For this reason, after performing the step cooling in the normalizing process, it is possible to easily perform the precise temperature control in the cooling process and the temperature maintaining process with high precision.

Further, since it is possible to perform the normalizing in the heating chamber 2, it is not necessary to take out the workpiece W from the heating chamber 2 for the normalizing. Accordingly, the number of times for moving the high-temperature workpiece W does not increase, and it is possible to avoid defects such as deformity caused by moving the high-temperature workpiece W.

Figure 9:
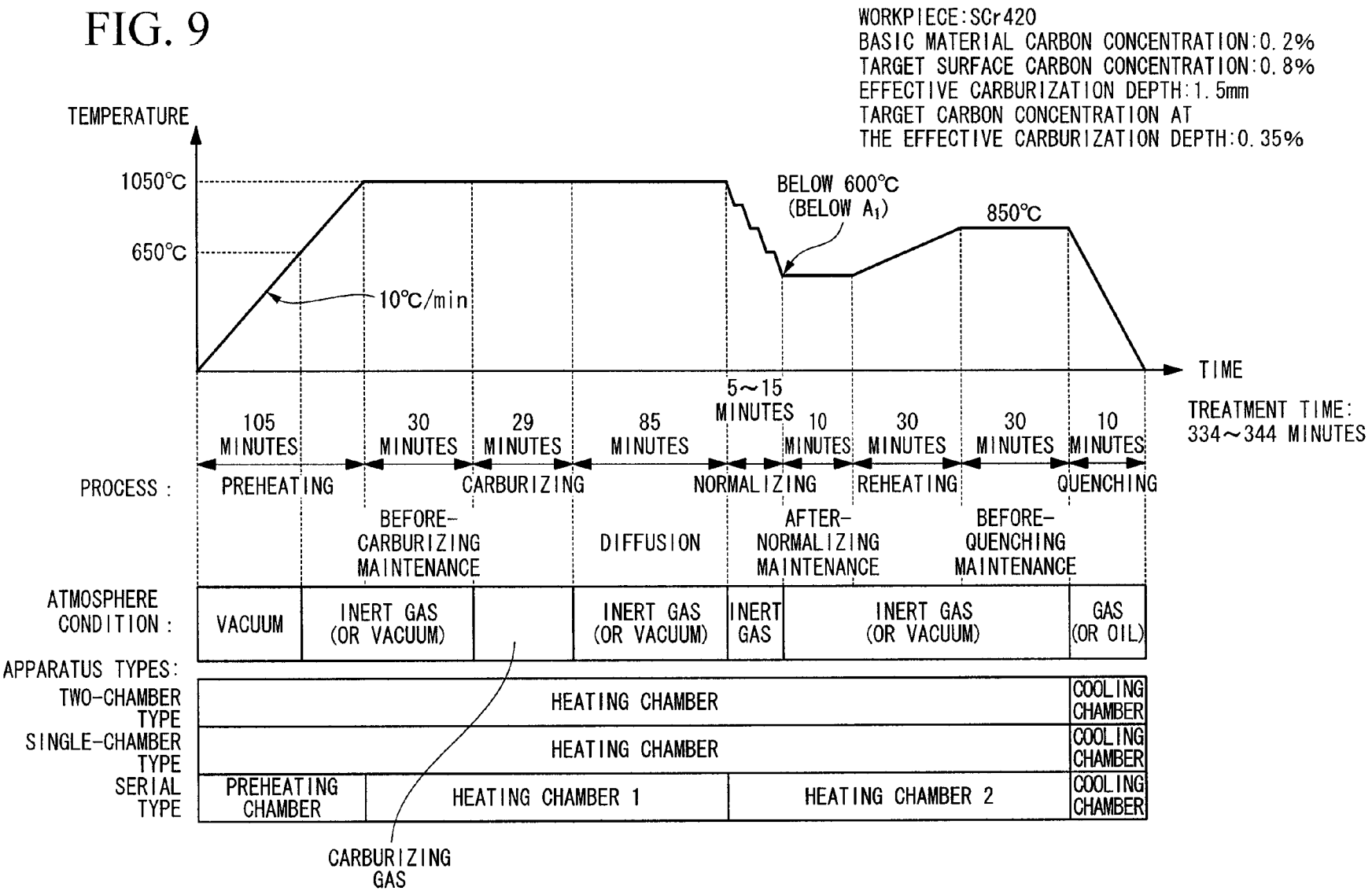
FIG. 9 is a diagram illustrating a treatment time and a temperature in each process of vacuum carburization, an atmosphere condition, and examples of apparatus types according to an embodiment of the invention. (different in an effective carburization depth from FIG. 6)

FIG. 9 is a diagram illustrating a treatment time and a temperature in each process, an atmosphere condition, and examples of apparatus types according to an embodiment of the invention, where a steel material such as SCr420 having a basic material carbon concentration of 0.2% is used as a workpiece material; a target surface carbon concentration is 0.8%; an effective carburization depth is 1.5 mm; and a target carbon concentration in the effective carburization depth is 0.35%. That is, in the vacuum carburization shown in FIG. 9, the same steel material as the vacuum carburization shown in FIG. 6 is used as a workpiece, and a difference from the vacuum carburization shown in FIG. 6 is that the effective carburization depth is 1.5 mm.

Similarly to FIG. 6, the process time of the processes in the diagram is calculated by the diffusion equation using Fick's second law.

In the vacuum carburization shown in FIG. 9, since the effective carburization depth is set larger than that of the vacuum carburization, the process time of the carburizing process and the diffusion process is set longer. The process time of the other processes shown in FIG. 9 is the same as FIG. 6.

As described above, even in the vacuum carburization in which the effective carburization depth is set large, it is possible to efficiently change the temperature at the time of temperature raising and temperature maintaining, by driving the fan F1 and by opening and closing the doors 53*a*, 54*a*, and 55*a* of the wind-path switching mechanism. In addition, even in the vacuum carburization in which the effective carburization depth is set large, it is possible to produce fine crystal grains of the workpiece W by performing the step cooling the normalizing process, even when the crystal grains are made coarse by performing the carburizing and the diffusion with a high temperature in order to shorten the process time. For this reason, while shortening the process time by the high-temperature process, the crystal grains are prevented from becoming coarse due to the high-temperature process. Therefore, it is possible to obtain the workpiece W having a predetermined property value.

Next, a degassing process will be described. In the embodiment, when a ground fault occurs in the heater 22, the degassing process is performed. In the degassing process, when a value of ground-fault current measured by the ammeter 23*g* is over a threshold value, the workpiece W is not placed in the furnace 50; the temperature in the furnace 50 is raised higher than a process temperature (1050° C. in the embodiment) by 50° C. to 150° C.; the temperature is maintained; and then the workpiece W is cooled. According to the degassing process, soot in the furnace 50 is evaporated.

In the degassing process, the temperature in the heating chamber 2 is raised to about 1200° C. However, every member provided in the furnace 50 is made of materials that are not evaporated even when the temperature in the furnace 50 is raised to about 1300° C. Without damage of the member, it is possible to remove soot.

In performing the aforementioned degassing process, the structure of the heater 22 is modified from the conventional structure. That is, in order to prevent a problem caused by attachment of the soot, the conventional heater has a structure in which a heating portion such as a current applied portion is covered with an insulating element such as ceramics and heat is indirectly conducted to the outside through the insulating element.

However, when the normalizing process according to the embodiment is performed in the furnace 50 of the heating chamber 2, in the conventional structure the insulating ceramic covering the current applied portion is broken off because the ceramic is rapidly cooled from the heated state. Thus, the furnace 50 having the structure according to the embodiment is used.

The furnace 50 having the structure according to the embodiment can endure rapid cooling from the heated state. However, in the heater 22 having the structure according to the embodiment shown in FIG. 5, when the heater supporter 26 is covered with soot, a ground fault occurs. On the contrary, in the present embodiment, a ground-fault current is monitored. When the ground-fault current is over a predetermined threshold value, a degassing process is performed to recover from the ground-fault state, thereby preventing damage caused by the ground fault.

The above embodiment is described using the vacuum carburization apparatus of the two-chamber type shown in FIGS. 1 to 3, but in the other type of vacuum carburization apparatus, the vacuum carburization of performing the normalizing process and the reheating process after the diffusion process may be performed as described in the above embodiment.

Figure 10:
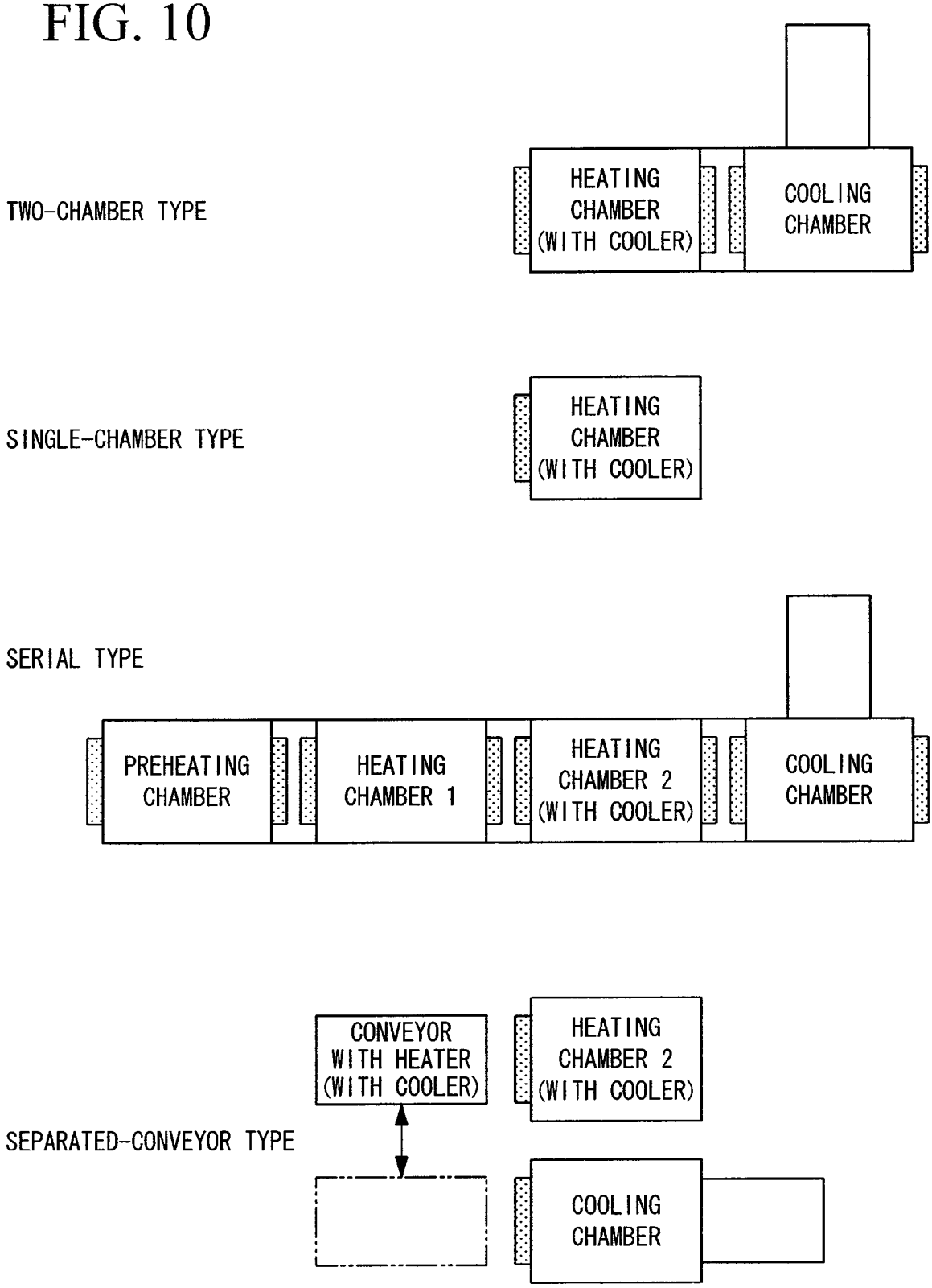
FIG. 10 is a schematic view illustrating an example of a vacuum carburization apparatus according to an embodiment of the invention.

FIG. 10 is a schematic view illustrating examples of types of the vacuum carburization apparatus. As shown in FIG. 10, in terms of types of the vacuum carburization apparatus, there are a single-chamber type, a serial type, a separated-conveyor type, and the like, in addition to the two-chamber type according to the above embodiment.

The single-chamber type is formed of only a heating chamber without a chamber only for cooling, and a cooler corresponding to the second cooler 40 is provided in the heating chamber. In the single-chamber type, since the cooler is provided in the heating chamber, a temperature lowering rate is low. Accordingly, the single-chamber type can be used in a case where a steel material with a good quenching property is a workpiece. The steel material such as SCr420 that is the workpiece in the above embodiment is poor in a quenching property. Therefore, it is difficult to perform the quenching process in the single-chamber type.

The serial type is used in a case where a plurality of workpieces W are vacuum carburized in series, and includes a preheating chamber, a first heating chamber, a second heating chamber, and a cooling chamber. The second heating chamber is provided with a cooler. In such a serial type, for example, the preheating process is performed in the preheating chamber; the before-carburizing maintaining process, the carburizing process, and the diffision process are performed in the first heating chamber; the normalizing process, the reheating process, and the before-quenching maintaining process are performed in the second heating chamber; and the quenching process is performed in the cooling chamber, thereby performing the vacuum carburization in such an order. Since the workpiece W sequentially moves through each process chamber according to the processes, it is possible to sequentially perform the vacuum carburization of a plurality of workpieces W.

In the separated-conveyor type, the heating chamber 2 and the cooling chamber 3 according to the above embodiment are not provided in the same case 1 and are separated from each other, and a conveyor for conveying the workpiece W moving between both chambers is provided additionally. Similarly to the above embodiment, in the processes of the vacuum carburization, the preheating process to the before-quenching maintaining process is performed in the heating chamber, and the quenching process is performed in the cooling chamber.

In this case, the preheating chamber is not limited to one, but a plurality of heating chambers may be provided. In the vacuum carburization, the time required the heating chamber is longer than the time in the cooling chamber. Accordingly, when a ratio of the number of heating chambers and the number of cooling chambers is 1:1, the time when the cooling chamber is empty becomes long. However, when the heating chamber is additionally provided on the basis of the number of workpieces, the works are sequentially conveyed from the plurality of heating chambers to the cooling chamber and thus the empty time of the cooling chamber is reduced to effectively use the cooling chamber. Therefore, it is possible to efficiently perform the vacuum carburization. When the plurality of heating chambers are provided, at least one among the heating chambers includes a cooler and the other heaters may not include a cooler.

As an example of the separated-conveyor type, in addition to the shown type, there may be a type further including a main container and a preparing chamber. For example, the main container is a cylindrical airtight container. One or a plurality of heating chambers, cooling chambers, and preparing chambers are connected in a radial shape to a peripheral side of the cylindrical main container. A conveyor is housed in the main container. The conveyor rotates at a position connected to any one of the heating chamber, the cooling chamber, and the preparing chamber in the main container.

In such a vacuum carburization apparatus, when a user puts a workpiece in the preparing chamber, the conveyor conveys the workpiece from the preparing chamber to the heating chamber; conveys the workpiece from the heating chamber to the cooling chamber; and conveys the workpiece from the cooling chamber to the preparing chamber. Then, the user takes the workpiece out from the preparing chamber.

According to the vacuum carburization process apparatus, the workpiece passes through the main container every time the workpiece is conveyed between the chambers. Therefore, the workpiece is securely allowed not to come into contact with the outside air until when the workpiece is put in the preparing chamber, the vacuum carburization is performed, and the workpiece is taken out from the preparing chamber. While the workpiece is placed in the heating chamber or the cooling chamber, the other workpiece can be put in the preparing chamber. Accordingly, in the vacuum carburization of the plurality of workpieces, it is possible to effectively use the chambers of the vacuum carburization apparatus.

The shape of the container is an example. There may be used the container in which the conveyor is housed and to which the heating chamber, the cooling chamber, and preparing chamber are connected.

In addition, the conveyer may include the heating chamber and/or the cooling chamber. In this case, it is possible to convey the workpiece between the heating chamber and the cooling chamber while controlling the temperature of the workpiece. Furthermore, when the conveyor is made to communicate with the heating chamber or the cooling chamber, the temperature in the heating chamber (or the temperature in the cooling chamber) and the temperature in the conveyor can be matched equivalently with each other by a heater (or cooler) of the conveyor. The workpiece after the vacuum carburization can be cooled to a normal temperature by the cooler of the conveyor.

Next, a vacuum carburization apparatus according to another embodiment of the invention will be described with reference to FIG. 11.

Figure 11:
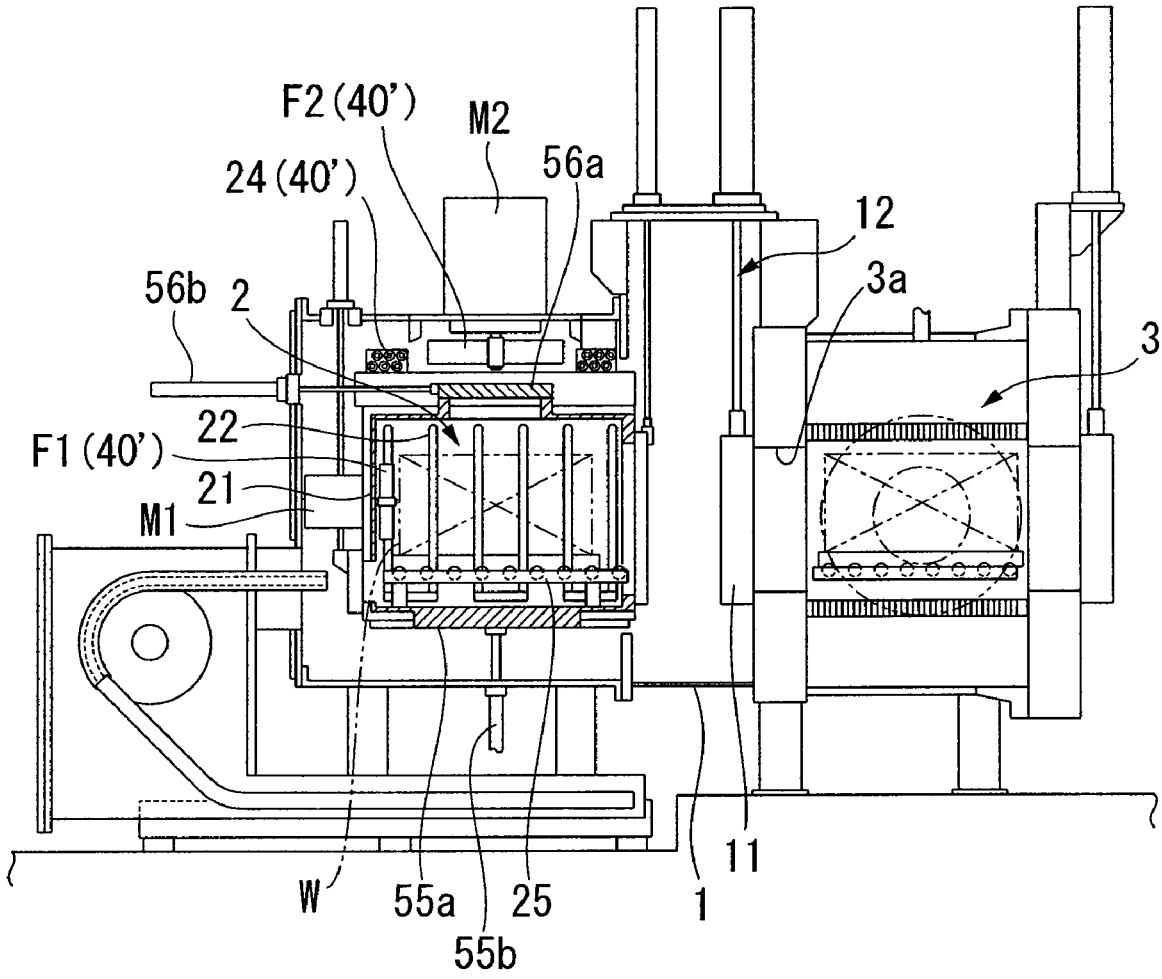
FIG. 11 is a sectional view illustrating a configuration of a vacuum carburization apparatus according to another embodiment of the invention.

FIG. 11 is a sectional view illustrating a configuration of the vacuum carburization apparatus.

The present embodiment is different from the other embodiment in that the heater 2 is provided with a second gas convection device in addition to the aforementioned first gas convection device.

As shown in FIG. 11, a motor M1 is disposed on a side surface of the furnace 50, and a fan F1 (first gas convection device) is attached to the motor M1 through a shaft (not shown).

In addition, a motor M2 is disposed above the heating chamber 2, and a fan F2 (second gas convection device) is attached to the motor M2 through a shaft (not shown). The fan F2 is provided outside the furnace 50 of the heating chamber 2 and circulates the gas in the heating chamber 2. A door 56*a* (first door) is openably and closably provided on the upper surface of the furnace 50, and cylinders 56*b* and 55*b* are connected to the door 56*a*. That is, in the embodiment, a second cooler 40' includes the fan F1, the fan F2, and the heat exchanger 24.

According to the present embodiment, there is the same advantage as the case where only the fan F1 is provided as described in the above embodiment. In addition, it is possible to further efficiently change the temperature in the heating chamber 2 by driving both of the fan F1 and the fan F2 at the time of opening the doors 56*a* and 55*a* of the furnace 50.

The technical scope of the invention is not limited to the aforementioned embodiments, but the aforementioned embodiments may be variously modified within the scope from which the conception of the invention does not deviate. In the above embodiment, there is used the first cooler 31 that circulates the high-pressure gas to cool the workpiece W, but, for example, the workpiece W may be cooled by an oil-cooling system.

Figure 12:
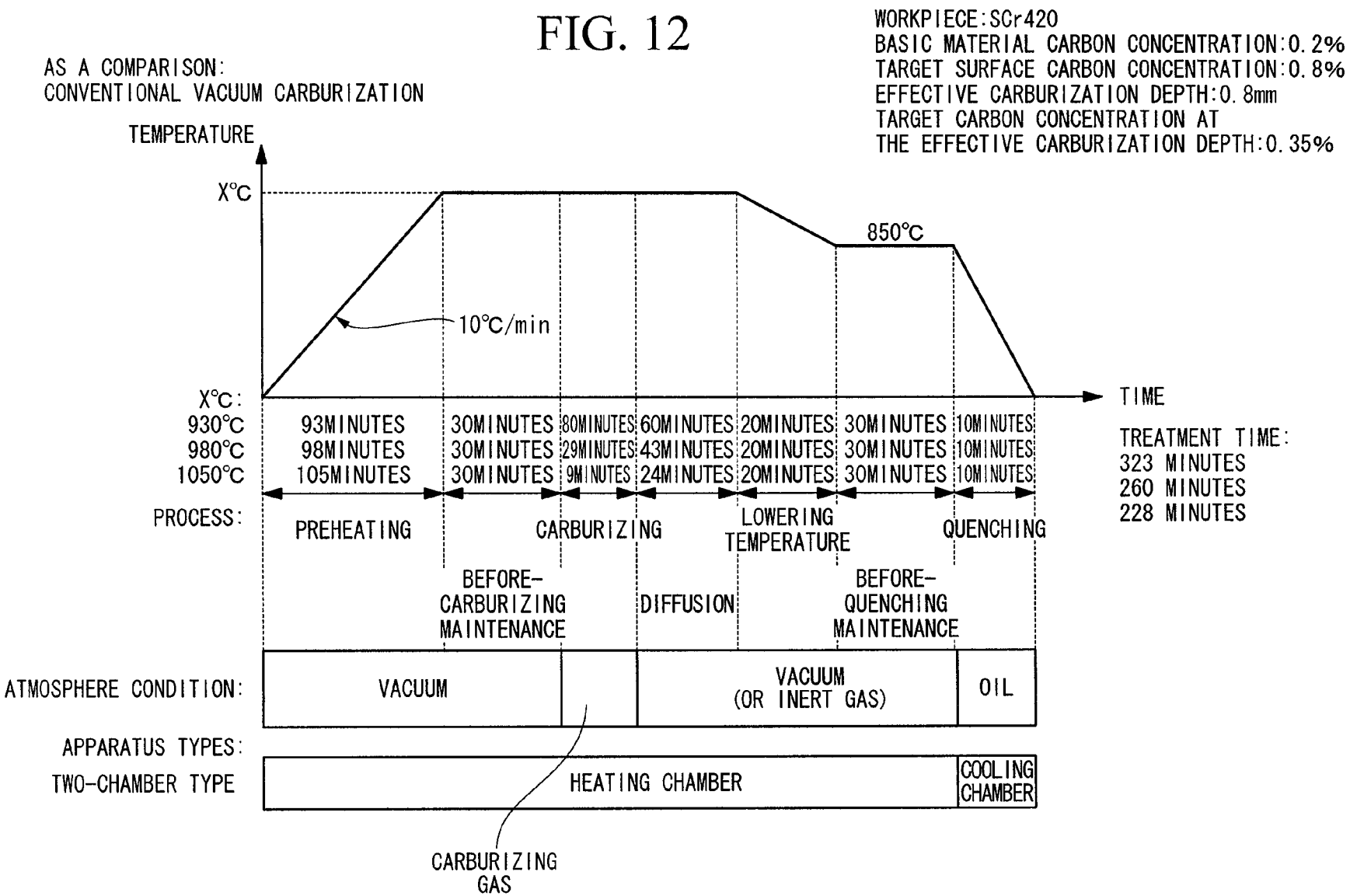
FIG. 12 is a diagram illustrating a treatment time and a temperature in each process of the conventional vacuum carburization, an atmosphere condition, and examples of apparatus types when a ring gear for automobile is processed.
Figure 13:
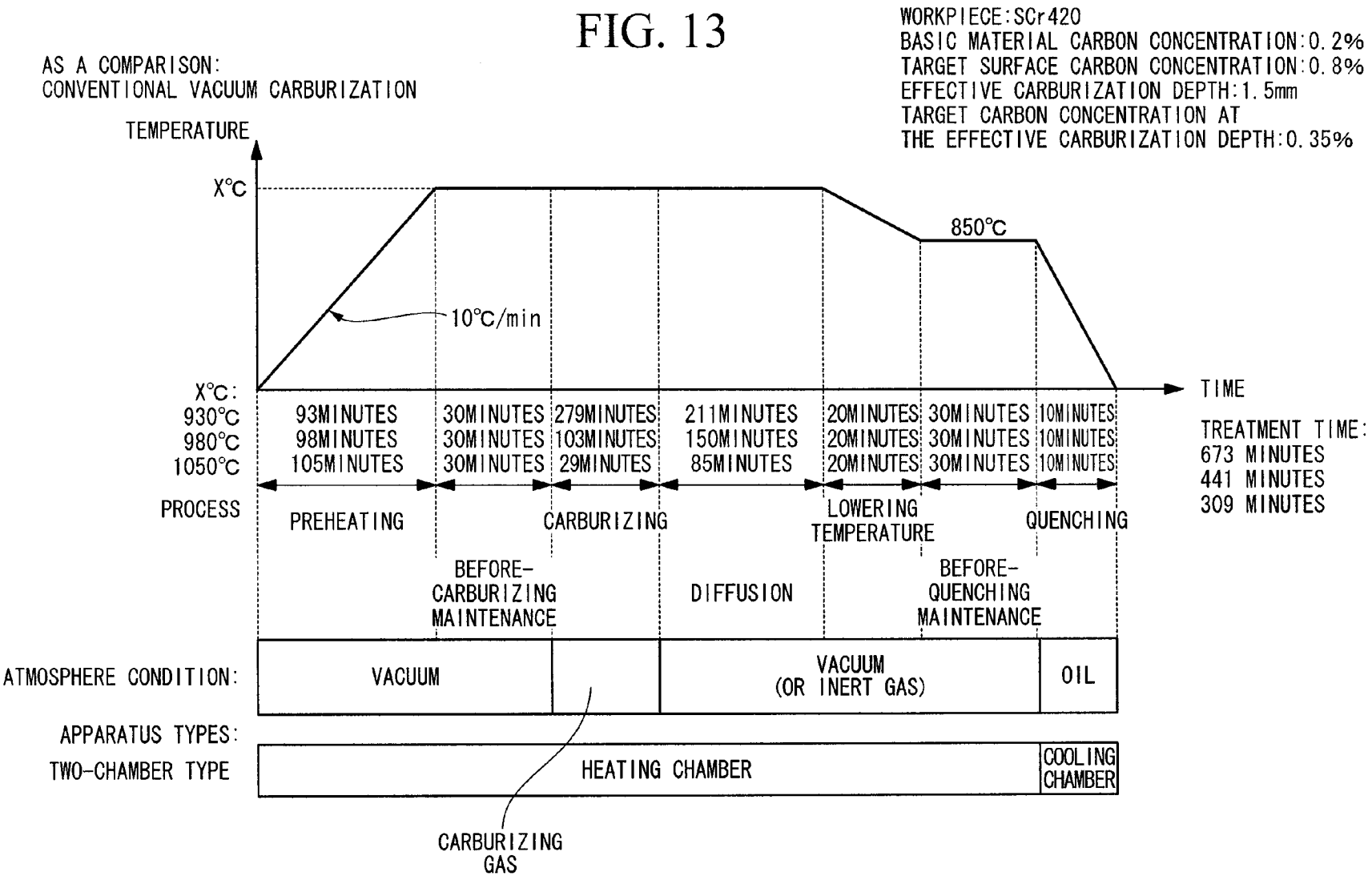
FIG. 13 is a diagram illustrating a treatment time and a temperature in each process of the conventional vacuum carburization, an atmosphere condition, and examples of apparatus types when a ring gear for automobile is processed. (different in an effective carburization depth from FIG. 12)

The step cooling according to the embodiment is not limited to the normalizing process. As described in FIGS. 12 and 13, in the case of the conventional vacuum carburization in which the temperature is lowered to the quenching temperature in the temperature lowering process without performing the normalizing process and then the process is transferred to the before-quenching maintaining process, the step cooling may be performed in the temperature lowering process. Even in such a vacuum carburization, it is possible to produce fine crystal grains in the workpiece made coarse by the high-temperature process.

What is claimed is:

1. A vacuum carburization method comprising:

a preheating process of heating a workpiece in a heating chamber to a first temperature;

a carburizing process of supplying carburizing gas into the heating chamber to carburize the workpiece in a state where the inside of the heating chamber is depressurized into an extremely low pressure;

a diffusion process of stopping the supply of the carburizing gas so as to diffuse carbon from the surface of the workpiece to the inside thereof; and a quenching process of quenching the workpiece so as to cool the workpiece from a second temperature, the method further comprising performing, between the diffusion process and the quenching process, the following processes:

a normalizing process comprising a continuous step cooling sequence comprising: a first temperature lowering treatment followed without any intervening step by a first temperature maintaining treatment, and wherein the first temperature maintaining treatment is followed without any intervening step by a second temperature lowering treatment that is followed without any intervening step by a second temperature maintaining treatment so that a temperature history from the first temperature to a predetermined temperature satisfies a predetermined condition an after-normalizing maintaining process of maintaining the temperature of the whole workpiece for a predetermined time after the normalizing process so that the whole workpiece reaches the predetermined temperature, thereby producing fine crystal grains of the workpiece; and a reheating process, performed after the after-normalizing maintaining process, of raising the temperature of the workpiece to the second temperature.

2. The vacuum carburization method according to claim 1, wherein lowering temperatures in the temperature lowering treatments of the normalizing process are equivalently set.

3. The vacuum carburization method according to claim 1, wherein the carburizing process, the diffusion process, the normalizing process, and the reheating process are performed in the heating chamber.

4. The vacuum carburization method according to claim 1, wherein the quenching process is performed in a cooling chamber provided separately from the heating chamber, and the cooling chamber is configured to cool the work piece.

5. The vacuum carburization method according to claim 1, wherein the preheating process, the diffusion process, and the reheating process are performed in a state in which the heating chamber is depressurized to an extremely low pressure state or in a state in which the heating chamber is filled with inert gas.

6. The vacuum carburization method according to claim 1, wherein the continuous step cooling sequence comprises a further temperature lowering treatment and a further temperature maintaining treatment, the further temperature lowering treatment and the further temperature maintaining treatment performed in sequence continuously, without intervening steps, and performed immediately following without intervening steps the temperature maintaining treatment.

7. The vacuum carburization method according to claim 1, wherein during the continuous step cooling sequence, each temperature lowering treatment takes less time than an immediately subsequent temperature maintaining treatment.

8. The vacuum carburization method according to claim 1, wherein during the continuous step cooling sequence, each temperature lowering treatment takes as much time as every other temperature lowering treatment of the continuous step cooling sequence.

9. The vacuum carburization method according to claim 1, wherein during the continuous step cooling sequence, each temperature maintaining treatment takes as much time as every other temperature maintaining treatment of the continuous step cooling sequence.

* * * * *